US005516969A

United States Patent [19]

Krasznai et al.

[11] Patent Number: 5,516,969

[45] Date of Patent: May 14, 1996

[54] WASTE OIL DECONTAMINATION PROCESS

[75] Inventors: John P. Krasznai, Burlington; Walter J. Janis, Etobicoke, both of Canada

[73] Assignee: Ontario Hydro, Toronto, Canada

[21] Appl. No.: 376,980

[22] Filed: Jan. 23, 1995

[51] Int. Cl.[6] ..... G21F 9/00

[52] U.S. Cl. ..... 588/20; 210/759; 208/251 R; 208/253

[58] Field of Search ..... 588/1, 20, 18; 210/759, 763; 208/180, 251 R, 253

[56] References Cited

U.S. PATENT DOCUMENTS

| | | | |
|---|---|---|---|
| 3,763,036 | 10/1973 | Jordan et al. | 208/180 |
| 3,923,643 | 12/1975 | Lewis et al. | 208/179 |
| 4,021,333 | 5/1977 | Habiby et al. | 208/179 |
| 4,615,794 | 10/1986 | Belanger | 208/181 |
| 4,623,448 | 11/1986 | O'Connell et al. | 208/262 |
| 4,624,792 | 11/1986 | Yamanaka et al. | 210/759 |
| 4,681,705 | 7/1987 | Robertson | 252/63.1 |
| 4,686,068 | 8/1987 | Saida et al. | 252/632 |
| 4,764,281 | 8/1988 | Elfline | 210/668 |
| 4,800,024 | 1/1989 | Elfline | 210/665 |
| 4,892,684 | 1/1990 | Harp | 252/626 |
| 4,902,665 | 2/1990 | Elfline | 502/402 |
| 4,925,597 | 5/1990 | Ganter | 252/631 |
| 4,948,493 | 8/1990 | Wilson | 208/179 |
| 5,075,044 | 12/1991 | Augem | 252/631 |
| 5,076,936 | 12/1991 | Metz | 210/662 |
| 5,139,679 | 8/1992 | Pan et al. | 210/656 |
| 5,160,636 | 11/1992 | Gilles et al. | 210/763 |
| 5,196,113 | 3/1993 | Metz | 210/181 |
| 5,286,380 | 2/1994 | Mellen | 210/296 |

*Primary Examiner*—Ngoclan Mai
*Attorney, Agent, or Firm*—Ridout & Maybee

[57] ABSTRACT

Heavy metals are removed from waste lubricating oil by heating in the presence of an oxidation catalyst and a free radical initiator at temperatures in the range of about 150°–200° C. Corrosion and oxidation inhibitors previously added to the oil are thereby oxidized to form a separable sludge which contains the bulk of heavy metal contamination. The process is of particular advantage in removing contaminating radioactive nuclides from lubricating oils used in nuclear generating facilities.

7 Claims, 1 Drawing Sheet

WASTE OIL DECONTAMINATION PROCESS

FIELD OF THE INVENTION

This invention relates to a method of removing heavy metal contaminants (e.g., Co,Pb,Cd) from waste oil, and in particular to the removal of contaminating radioactive nuclides from oils used in nuclear power plants.

BACKGROUND OF THE INVENTION

Nuclear power plants and other facilities handling radioactive material generate radioactively contaminated lubricating oil comprising mixtures of turbine-type, hydraulic or gear oils and lesser amounts of synthetic oils found in general nuclear service. This radioactive waste oil presents a serious disposal problem. To permit off-site disposal, the beta/gamma radioactivity of the waste oil must be reduced to non-detectable levels and the tritium content to below about 2μCi/kg (740 kBq/kg).

It has been recognized in the case of radioactive waste oil that one approach to reducing the end volume of processed radioactive waste, thereby facilitating its disposal, is to remove the actual radioactive contamination and process it, rather than treat the contaminated oil itself as the radioactive waste needing to be disposed. For example, U.S. Pat. No. 4,615,794 (Belanger) discloses a process in which the waste oil is pre-treated (filtered, heated and skimmed) and an amount of calcium or sodium hypochlorite is added to initiate salt formation with the radioactive contaminants. Treatment with a carbonated pH buffer then converts the nuclide cations into solid salts which can be filtered off.

A number of prior art patents relate to the decontamination of non-radioactive oils by the removal of undesirable (generally toxic) heavy metals such as lead. U.S. Pat. No. 5,286,380 (Mellen) describes a process in which 1 part of contaminated motor oil is mixed with about 10 parts of a suitable solvent such as butane, precipitants are allowed to settle, the solution is percolated through an activated charcoal filter and regenerated oil is separated by vaporizing off the solvent.

The present applicants have discovered a process for greatly reducing the concentration of heavy metals (principally lead and cadmium) from contaminated lubricating oils and especially for reducing radioactivity in such oils to acceptable levels by removal of metal nuclides. The process of the invention is advantageous in employing relatively mild conditions and, unlike prior art methods, requiring no handling of strong oxidants nor the addition of substantial quantities of reagents and/or solvents.

Commercial lubricating oils of the kind used in nuclear service contain, in addition to the base fluid (primarily non-polar, solvent-refined petroleum oil basestock), from about 0.5 to about 5% each of various additives intended to inhibit oxidative breakdown of the oil in use reduce wear, inhibit corrosion and modify rheological properties. Phenolic oxidation inhibitors and zinc-or phosphorous-based antiwear additives are typical. It will be understood throughout this specification that "lubricating oil" refers to such commercial, stabilized products.

From our investigations and experiments, it appears that the gamma-emitting radionuclides present in lubricating oils contaminated during nuclear service are associated not to any significant degree with the base oil itself, but primarily with the aforementioned thermal and oxidation resistance additives. According to the present method, waste lubricating oil heated in the presence of oxygen, a catalyst and a free radical promoter (initiator) forms an "oxidation sludge" containing essentially all of the gamma activity (principally from Co-60), which is believed to arise from the preferential and rapid degradation of the corrosion and oxidation inhibitors present in the lubricating oil.

OBJECTS AND SUMMARY OF THE INVENTION

It is an object of the present invention to provide a new method for removing heavy metal contaminants from waste hydrocarbon lubricating oil.

It is a more specific object of this invention to provide a simple and relatively inexpensive method for reducing the radioactivity of waste oil generated at a nuclear facility to a level which permits the oil to be safely transported for disposal or re-refinement.

It is a further object of this invention to provide a method of reducing the radioactivity of waste oil as aforesaid, in which the volume of radioactive materials that must be managed as radioactive waste is greatly reduced from the volume of the radioactive waste oil.

With a view to achieving these objects and overcoming the aforementioned disadvantages of prior oil decontamination methods, the invention is in one aspect thereof a method of removing heavy metal contaminants from lubricating oil, comprising adding an oxidation catalyst and a free radical initiator to the oil, heating the mixture to an elevated temperature in the range of about 150°–200° C. and bubbling oxygen or a mixture of oxygen and nitrogen through the oil/catalyst/initiator mixture until an insoluble sludge forms which contains the heavy metal contaminants. The sludge is then removed from the mixture by filtration or centrifugation, along with other solid and particulate materials to leave the decontaminated lubricating oil with a greatly reduced level of heavy metal contaminants.

According to another aspect of the invention, there is provided a method of removing radioactive contaminants from waste lubricating oil, comprising the steps of adding to the oil selected amounts of an oxidation catalyst and a free-radical initiator. Oxygen is flowed through the mixture while it is heated to an elevated temperature until an insoluble sludge separates from the liquid oil phase. Temperatures in the range of 150°–200° C. appear to be effective, the optimum temperature depending on the choice of initiator. This sludge contains substantially all of the beta/gamma radioactivity and, when the radioactivity in the liquid oil phase has fallen to an acceptable level, the radioactive sludge is removed from the oil.

According to preferred embodiments of the invention, metallic copper or an oil solution of cupric naphthenate is used as the catalyst and an organic peroxide such as cumene hydroperoxide is used as the free radical initiator, although other metallic surfaces and peroxides may respectively act as catalyst and initiation in the same manner.

BRIEF DESCRIPTION OF THE DRAWING

The accompanying drawing shows by way of example an embodiment of the invention, wherein.

DETAILED DESCRIPTION OF THE INVENTION

Figure 1:
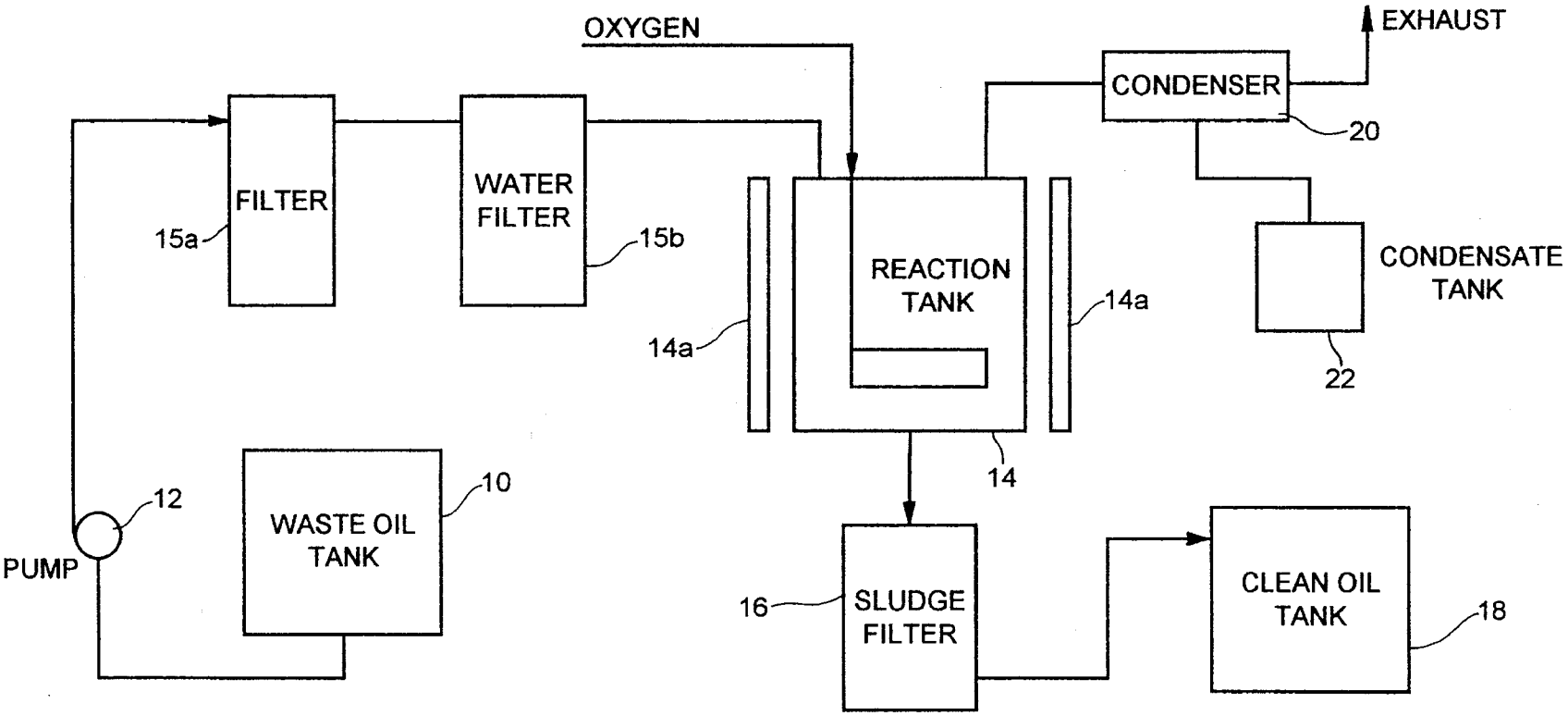
FIG. 1 is a process flow sheet describing a complete method of operation for removing radioactive waste from lubricating oil.

The method of the present invention involves a novel modification of a standard method for assessing the oxidation stability of mineral oils, ASTM D-2440-83 ("Standard Test Method for Oxidation Stability of Mineral Insulating Oil"). In the ASTM D-2440 accelerated aging test, oil is aged at 110° C. under flowing oxygen in the presence of a solid copper catalyst, and the production of sludge and acid products is monitored periodically by gravimetric and titration techniques, respectively. Under application of this test, unstable or poor quality oils will show evidence of significant oxidative degradation in as little as 24 hours.

When it was discovered by the present inventors that it is the oxidation-sensitive component (i.e. the additives which first sludge out) rather than the oxidation-resistant component (i.e. the base oil) rather than the base oil with which contaminating radionuclides associate, it became an object to accelerate the oil oxidation process of ASTM D-2440 to the greatest extent possible, but in a manner not requiring conditions or aggressive chemistries that would consume the oxidation-resistant base fluid component. It was intended, rather, to take advantage of the additives present in the oil as "sacrificial" materials, preferentially and rapidly oxidized to a nuclide-carrying, removable sludge. Minimizing oxidation of base fluid facilitates re-use of the treated oil for lubrication purposes, by simply reinhibiting the decontaminated oil with fresh additives.

preliminary scoping tests carried out on non-radioactive lubrication oils showed that this could be achieved by the introduction of free radicals at the very outset of treatment, in the form of added free radical peroxide initiators. Indeed, absent the addition of free radical initiators, it was seen to take anywhere from 250 to 1,000 hours of $O_2$ oxidation in the presence of a Cu catalyst before an appreciable amount of the desired sludging occurred, with a lubricating oil used at one of Ontario Hydro's nuclear plants.

FIG. 1 shows a schematic of the process flow sheet relating to the below-described tests on both radioactive and non-radioactive oils. The generalized apparatus for carrying out the method of the invention comprises a contaminated oil storage tank 10 from which pump 12 pumps the waste oil into reaction tank 14. Optionally, the oil may be routed through an oil pretreatment system (filter 15*a* and water removal system 15*b*, which may remove water conventionally by vacuum or filtration. pretreatment of the oil in this way, to remove bulk water from the oil, may be necessary where, for example, the oil is highly emulsified and contains substantial levels of tritium.

The oil is heated in reaction tank 14 by heaters 14*a*, in the presence of a solid or liquid catalyst, an initiator and oxygen gas to start the chemical reaction. After a selected period of reaction time, a sample of oil may be withdrawn from the upper portion of the reaction tank and its beta/gamma activity measured. The reaction is considered complete if the radioactivity of the oil is at or below current detection levels ($4\times10^{-7}$ μCi/g).

The oil may then be passed through sludge filtration means 16 and thence to a clean oil tank 18 for storage and subsequent disposal or re-refining of the non-radioactive decontaminated oil.

Exhaust gases from the reaction tank, comprising the oxygen or oxygen/nitrogen flow through and entrained vapours, preferably, are routed first through a condenser 20 from which chilled condensate is collected in tank 22 before the gas stream is vented, optionally through an activated carbon filter to remove volatile organics. While all of the radioactivity appears to be retained in the filtered sludge, water is a by-product of the oxidation and, when condensed, contains the bulk of any tritium contamination from the oil, as well as some of the volatile light ends. This "secondary" waste represents a very small volume of the total and can easily be managed.

Taking into account the tritiated water produced during the oxidation and the solid wastes (sludge and catalyst) that must be managed as radioactive waste, the volume reduction factor of this process is approximately 100. As noted below, the process reduces the lead concentration in oil to levels which are below 5 mg/kg.

(i) Materials

Used, waste turbine oil, ISO viscosity grade 32, from Ontario Hydro's Bruce Unit 7 nuclear facility was used in the preliminary scoping measurements on non-radioactive (inactive) materials. The liquid catalyst was 3500 mg/kg oil of 1% copper naphthenate, $(C_6H_5CO_2)_2$—Cu and the solid catalyst was a 25 cm length of coiled AWG No. 18 copper wire (1.8 g). The initiator used in these tests was cumene hydroperoxide $C_6H_5$—$C(CH_3)_2$—OOH.

The oil heating bath and glassware, consisting of a manifold of 210 mm×25 mm o.d. oil receptacles, each equipped with a gas delivery tube and head, were as described in the aforementioned ASTM D-2440-83, incorporated herein by reference.

(ii) Tests with Inactive Oils

The results are set out in Table 1 below. Two sets of four samples, A to H, each containing 25 g of oil were made up with the initiator and catalyst concentrations given in Table 1. The co-agents for accelerating oil oxidation were a cumene hydroperoxide initiator, together with a copper catalyst, the latter being investigated both as a solid and as an oil-soluble compound copper naphthenate, mixed at a concentration of 1% in petroleum oil. In measurements intended to determine the most effective combination of oxidation accelerators, the degree of sludging at around 200° C. in the presence of oxygen was used as a measure of successful oxidation, with a target minimum being 0.25% on a weight/weight basis. The procedure was as follows:

(1) An oil bath was heated to 110° C. and four sample tubes each containing 25 g of oil together with initiator and catalyst were placed in the bath.

(2) A flow of 1L/h pure oxygen was initiated through each sample tube and the bath was heated from 20° C. at a constant rate and reached 200° C. in 30 minutes. After 40 minutes at 200° C. (70 minutes total) the four samples were removed from the bath and allowed to cool in the dark overnight.

(3) The following day samples A and C were again placed in the heated (200° C.) oil bath for 2 hours. The quantity of sludge produced in each sample was determined according to the standard ASTM D 2440 procedure.

(4) Steps (1) to (3) were repeated for the second set of samples which did not contain copper catalyst.

From these measurements, it was concluded that a copper catalyst is essential to obtain any appreciable rate of sludging of the oil, initiator by itself even at high concentration does not result in efficient oxidation of the additives in the oil. Both the solid and liquid forms of the copper catalyst were seen to be effective. The quantity of sludge formed was found to be almost directly proportional to the time of treatment.

On the basis of these results an apparently favourable set of conditions was chosen for carrying out decontamination tests on radioactive material, namely:

TABLE 1

| | |
|---|---|
| Oxygen Flow Rate: | minimum of 1L/h |
| Temperature: | 185–200° C. |
| Duration: | 3 hours |
| Initiator Concentration: | 5,000 mg/kg |
| Catalyst Form: | Solid copper |

ACCELERATED SLUDGING TESTS - INACTIVE TRIALS

| Sample ID | Initiator Content (mg/kg) | Copper Catalyst Form | T (avg) (°C.) | t (min) | Sludge (% w/w) |
|---|---|---|---|---|---|
| A | 5000 | Liquid[1] | 195 | 190 | 0.70 |
| B | 5000 | Liquid[1] | 185 | 70 | 0.20 |
| C | 5000 | Solid | 195 | 190 | 0.83 |
| D | 5000 | Solid | 185 | 70 | 0.19 |
| E | 5000 | None | 185 | 70 | 0.05 |
| F | 15000 | None | 185 | 70 | 0.09 |
| G | 5000 | None | 195 | 190 | 0.15 |
| H | 15000 | None | 195 | 190 | 0.18 |

[1]As cupric naphthenate, concentration = 3500 mg/kg of a 1% solution in oil.

(iii) Treatment of Active Oil

The apparatus used in the inactive test was also employed for the active oil tests labelled "Run 1" and "Run 2" in Table 2 below. The exhaust gas from each tube was collected through a common manifold and routed through a glass condenser cooled to acetone/liquid nitrogen slush bath temperature to scrub out the condensibles. During Runs 1 and 2, the oil flask was kept at 200° C. in an oil bath. For Run 3, a 1,000 mL flask was used. The method was as follows:

(1) The oil flask was heated, at a constant rate of about 18° C./minute, from room temperature (23° C., approximately) to 200° C. in an oil bath. It was then maintained at 200° C. for the duration of the test.

(2) Oxygen was bubbled through the heated oil, then through the glass frit and then through the condenser cooled with a slush of liquid nitrogen/acetone (−78° C.).

(3) At the end of a test, the condensate was collected and its radioactive content determined.

(4) At the end of the test, the filterable, loose sludge formed during the process was filtered initially through a coarse Whattman #1 filter, followed by a 0.7μm glass fiber filter medium (GF/F). The filtered sludges on the filters were washed with n-heptane to remove any residual oil, combined and dried to constant weight.

(5) At the end of the test, adhered sludge remaining on the catalyst and flask surfaces was removed by ultrasonic cleaning. The radioactive content of the dried sludges was determined by gamma spectrometry.

(6) Calculation of Sludge Loss on Flask Surfaces:

The reaction vessels were difficult to clean completely even with the assistance of ultrasonics. After Run 2, one of the six vessels used was gamma scanned to determine the activity of the material adhering to its walls. Assuming the quantity of sludge adhering to each reaction vessel was the same, this number was then multiplied by the number of vessels used to process the quantity of oil used in each run. Because the vessels were used in two runs prior to gamma scanning the activity measured was divided between Run 1 and 2 in the ratio of the amount of sludge produced in the two runs (3:1).

Run 1 and 2 were carried out in six batches of 30 g each due to equipment limitations. Run 3 was carried out in a single 900 g batch size. Run 2 used air instead of oxygen to determine the oxygen requirements. The other runs used oxygen.

Runs 1 and 2 used the standard copper wire catalyst for the D 2440 test. Run 3 was a single batch using about 40 g of copper turnings which have the same specific area as 230 g of the standard copper wire that would have been required. The copper turnings were washed with acetone and rinsed in DI water to remove any organic impurities but it was not practical to abrade the turnings as suggested for the copper wire in the D 2440 procedure.

Table 2 summarizes the results of the three active Runs in terms of the activity remaining in the oil portion. Table 3 shows the corresponding quantities of the radionuclides filtered out with the filterable sludge. In addition to the loose, filterable sludge, a layer of strongly adhering, active sludge formed on the copper catalyst and glass reaction vessels during each reaction. Following removal by mechanical means, the activity of the removed material was determined by gamma spectrometry.

Because some residual material remained on reaction vessel, after mechanical sludge removal, a minor correction for this loss was required, and was obtained by gamma scanning the reaction flasks after sludge removal as outlined above.

The data shows that the majority of the Co-60 radioactivity is found in the filtered sludge. Additionally, the lead concentration the oil was reduced in Run 1 from 6.7 mg/kg to the detection limit (<0.12 mg/kg).

Table 2 shows that the oxygen content of the gas flowing through the oil was changed by substituting air for pure oxygen in Run 2. While similar decontamination factors were achieved, the use of air instead of oxygen generated much less sludge, even though the process was allowed to run for six rather than three hours. The effect of oxygen concentration in Run 2 appeared to be low enough to limit the rate of the oxidation reaction.

TABLE 2

CONCENTRATION OF RADIONUCLIDES IN DECONTAMINATED OIL

| | | RUN 1 | RUN 2 | RUN 3 |
|---|---|---|---|---|
| | Flow Rate | 1 L/h $O_2$g oil | 1 L/h air/25 g oil | 16 L/h $O_2$/500 g oil |
| | Temperature | 185–200° C. | 185° C. | 200° C. |
| | Duration | 3 h | 6 h | 3 h |
| | Wt. of oil | 732 g | 780 g | 886 g |
| NUCLIDES | BEFORE (μCi/g) | AFTER (μCi/g) | AFTER (μCi/g) | AFTER (μCi/g) |
| H-3 | 0.027 | 0.004 | 0.003 | 0.003 |
| Co-60 | (1.3 ± 0.1)E-5 | (1.8 ± 0.7)E-8 | (1.2 ± 0.3)E-7 | (3.0 ± 1)E-8 |
| Ru-106 | n.d | n.d | n.d | n.d |

TABLE 2-continued

| CONCENTRATION OF RADIONUCLIDES IN DECONTAMINATED OIL | | | | |
|---|---|---|---|---|
| Sb-124 | n.d | n.d | <6.9E-8 | <6.8E-8 |
| Sb-125 | (3.5 ± 1.0)E-7 | n.d | <8.2E-8 | <6.7E-8 |
| Cs-134 | (2.1 ± 0.1)E7 | (3.1 ± 0.7)E-8 | <3.1E-8 | <1.5E-8 |
| Cs-137 | (3.4 ± 0.3)E-6 | (4.9 ± 0.4)E-7 | <3.2E-8 | <1.5E-8 |
| Ce-144 | (5.0 ± 2.1)E-7 | n.d | n.d | n.d |
| Eu-152 | (2.8 ± 1.0)E-7 | n.d | n.d | n.d |
| Eu-154 | n.d | n.d | n.d | n.d |
| Eu-155 | n.d | n.d | n.d | n.d |
| Am-241 | n.d | n.d | n.d | n.d |
| TOTAL (γ) | 1.77E-5 | 5.4E-7 | <3.3E-7 | <1.9E-7 |

n.d - not detected

TABLE 3

| QUANTITY AND COMPOSITION OF ACTIVITY (μCi) IN FILTERED, LOOSE SLUDGE | | | |
|---|---|---|---|
| | RUN 1 | RUN 2 | RUN 3 |
| WT OF SLUDGE (g) | 4.6 | 1.5 | 6.1 |
| SLUDGE AS A PERCENT OF OIL TREATED | 0.63 | 0.19 | 0.69 |
| Co-60 | (7.7 ± 0.1)E-3 | (9.2 ± 0.1)E-3 | (8.5 ± 0.1)E-3 |
| Ru-106 | (8.6 ± 5.0)E-5 | n.d | (1.6 ± 0.7)E-4 |
| Sb-124 | <1.6E-5 | (1.0 ± 0.1)E-5 | <1.4E-5 |
| Sb-125 | (1.7 ± 0.1)E-4 | (1.6 ± 0.1)E-4 | (2.0 ± 0.2)E-4 |
| Ce-134 | (1.0 ± 0.1)E-4 | (1.1 ± 0.1)E-4 | (1.2 ± 0.1)E-4 |
| Ce-137 | (1.3 ± 0.02)E-3 | (1.4 ± 0.02)E-3 | (1.6 ± 0.02)E-3 |
| Ce-144 | (4.0 ± 0.2)E-4 | (4.6 ± 0.1)E-4 | (4.5 ± 0.2)E-4 |
| Eu-152 | (1.6 ± 0.2)E-4 | (1.8 ± 0.1)E-4 | (1.8 ± 0.2)E-4 |
| Eu-154 | (8.9 ± 1.4)E-5 | (2.0 ± 0.1)E-4 | (9.7 ± 2.0)E-5 |
| Eu-155 | n.d | (5.8 ± 0.6)E-S | n.d |
| Am-241 | (3.4 ± 1.0)E-5 | (4.5 ± 1.0)E-5 | n.d |
| TOTAL | 1.0E-2 | 1.2E-2 | 1.1E-02 |

(iv) Conclusions (1) Controlled oxidation in the presence of copper catalyst at 200° C. can reduce the gamma activity in waste oil by 2 orders of magnitude to the detection limit ($<2\times10^{-7}$μCi/g). The tritium concentration was reduced in this work to 3μCi/kg but this level can be further reduced by pre-drying the oil.

(2) All of the gamma activity is retained in the filtered sludge. Water is a byproduct of the oxidation and when condensed will contain the bulk of the tritium contamination from the oil as well as some of the volatile light ends. This represents a very small volume of secondary waste that can easily be managed. It is estimated that the volume reduction factor achieved by this process is of the order of 100.

(3) Pure oxygen is more effective than air at a 1L/h flow rate under the test conditions and results in a reduced processing time.

(4) The end product from this process is a very dark oil with a high acid number. While it is possible to further treat this oil to reduce its acidity and reconstitute its additive package, the economics of so doing has not been assessed.

(5) The data from one experiment suggests that lead contamination is very effectively removed in this process.

The invention having been so described, certain modifications and adaptations will be obvious to those skilled in the art. The invention includes all such modifications and adaptations which followed in the scope of the appended claims.

We claim:

1. A method of removing radioactive contaminants from waste lubricating oil, comprising the steps of:

(i) adding to a batch of waste lubricating oil to be decontaminated selected effective proportions of an oxidation catalyst and a free radical initiator;

(ii) flowing oxygen through the oil/catalyst/initiator mixture while heating the mixture to an elevated temperature in the range of about 150° C. to about 200° C. until an insoluble sludge separates from the liquid oil phase and the beta/gamma radioactivity in said liquid phase has fallen to an acceptable level; and (iii) filtering the radioactive sludge from the oil.

2. A method according to claim 2, wherein said oxidation catalyst is a copper catalyst and said free radical initiator is an organic peroxide.

3. A method according to claim 2, wherein said catalyst is selected from the group consisting of metallic copper wire, metallic copper turnings and cupric naphthenate.

4. A method according to claim 3, wherein said mixture is maintained at said elevated temperature until the amount of sludge formed is at least 0.25% of the amount of oil in the batch on a weight/weight basis.

5. A method according to claim 3, wherein step (ii) is carried out in a reaction vessel having gas inlet means for receiving a stream of oxygen or oxygen/nitrogen mixtures and gas outlet means for removing a stream of excess gas and vapours generated in the reaction.

6. A method according to claim 5, wherein said waste lubricating oil is pre-treated prior to step (i) by the removal of any bulk water present.

7. A method of removing heavy metal contaminants from lubricating oil, comprising the steps of:

(i) contacting a given quantity of the oil with selected effective proportions of an oxidation catalyst and a free radical initiator;

(ii) heating the oil, catalyst and initiator together to an elevated temperature in the range of about 150° C. to about 200° C;

(iii) maintaining said elevated temperature while bubbling oxygen through the mixture of oil, catalyst and initiator until an insoluble sludge forms in the mixture containing heavy metal contaminants; and (iv) remove from the mixture sludge containing heavy metal contaminants and other solid and particulate materials from the lubricating oil.

* * * * *